US009444172B2

(12) United States Patent
Kawakami et al.

(10) Patent No.: US 9,444,172 B2
(45) Date of Patent: Sep. 13, 2016

(54) CONNECTOR

(71) Applicant: Hosiden Corporation, Yao-shi, Osaka (JP)

(72) Inventors: Yuta Kawakami, Yao (JP); Daisuke Sasaki, Yao (JP); Takayuki Nagata, Yao (JP)

(73) Assignee: HOSIDEN CORPORATION, Yao-Shi (JP)

( * ) Notice: Subject to any disclaimer, the term of this patent is extended or adjusted under 35 U.S.C. 154(b) by 0 days.

(21) Appl. No.: 14/725,050

(22) Filed: May 29, 2015

(65) Prior Publication Data

US 2015/0349448 A1 Dec. 3, 2015

(30) Foreign Application Priority Data

Jun. 2, 2014 (JP) ..... 2014-113727

(51) Int. Cl.

| | |
|---|---|
| ***H01R 13/428*** | (2006.01) |
| ***H01R 13/11*** | (2006.01) |
| ***H01R 13/187*** | (2006.01) |
| *H01R 13/422* | (2006.01) |
| *H01R 13/52* | (2006.01) |

(52) U.S. Cl.

CPC ..... *H01R 13/428* (2013.01); *H01R 13/114* (2013.01); *H01R 13/187* (2013.01); *H01R 13/113* (2013.01); *H01R 13/4223* (2013.01); *H01R 13/5205* (2013.01)

(58) Field of Classification Search

CPC ..... H01R 13/4223

USPC ..... 439/595

See application file for complete search history.

(56) References Cited

U.S. PATENT DOCUMENTS

| | | | | |
|---|---|---|---|---|
| 5,593,328 | A * | 1/1997 | Okada | H01R 13/11 439/843 |
| 5,607,318 | A * | 3/1997 | Wakata | H01R 13/4223 439/274 |
| 5,851,128 | A * | 12/1998 | Nakata | H01R 13/4223 439/752 |
| 5,989,066 | A * | 11/1999 | Cox | H01R 13/4365 439/595 |
| 6,083,033 | A * | 7/2000 | Yamamoto | H01R 13/113 439/381 |
| 6,186,806 | B1 * | 2/2001 | Suzuki | H01R 13/422 439/189 |

(Continued)

FOREIGN PATENT DOCUMENTS

JP 2008-218198 9/2008

*Primary Examiner* — Ross Gushi

(74) *Attorney, Agent, or Firm* — Rankin, Hill & Clark LLP

(57) ABSTRACT

A connector in which a large contact pressure between male and female terminals is obtained. The female terminal has an elastic wall portion that is outwardly pressed by the displaced elastic contact piece to be displaced. The elastic lance is disposed on the side of the elastic wall portion of the socket portion so as to be outwardly pressed by the displaced elastic wall portion to be displaced. The displaced elastic contact piece is pressed by the displaced elastic wall portion and the elastic lance, thereby increasing the contact pressure of the elastic contact piece.

1 Claim, 13 Drawing Sheets

(56) References Cited

U.S. PATENT DOCUMENTS 6,193,549 B1 * 2/2001 Suzuki ..... H01R 13/4223 439/511
6,227,915 B1 * 5/2001 Sakatani ..... H01R 13/11 439/752.5
6,547,608 B2 * 4/2003 Sato ..... H01R 13/11 439/851
6,767,259 B2 * 7/2004 Kojima ..... H01R 13/114 439/595
6,948,978 B2 * 9/2005 Itou ..... H01R 13/4364 439/595
6,948,986 B2 * 9/2005 Kojima ..... H01R 13/432 439/595
7,001,214 B2 * 2/2006 Fujii ..... H01R 13/4223 439/595
7,189,124 B2 * 3/2007 Kobayashi ..... H01R 13/422 439/850
7,223,124 B2 * 5/2007 Nakamura ..... H01R 13/422 439/595
7,226,313 B2 * 6/2007 Shamoto ..... H01R 13/4223 439/595
7,229,328 B2 * 6/2007 Sawada ..... H01R 13/113 439/595
7,229,329 B2 * 6/2007 Yamashita ..... H01R 13/11 439/595
7,297,032 B2 * 11/2007 Kobayashi ..... H01R 13/4361 439/595
7,374,465 B2 * 5/2008 Tanaka ..... H01R 13/113 439/595
7,841,913 B2 * 11/2010 Hitchcock ..... H01R 13/4223 439/541.5
8,210,864 B1 * 7/2012 Hernandez ..... H01R 13/4362 439/352
8,241,076 B2 * 8/2012 Kubota ..... H01R 13/113 439/852
8,708,759 B2 * 4/2014 Hirabayashi ..... H01R 13/113 439/595
8,747,156 B2 * 6/2014 Hirabayashi ..... H01R 13/113 439/595
8,764,482 B2 * 7/2014 Matsumura ..... H01R 13/113 439/595
8,784,144 B2 * 7/2014 Hirabayashi ..... H01R 13/113 439/852
2002/0002001 A1 * 1/2002 Fukamachi ..... H01R 13/4223 439/587
2002/0081913 A1 * 6/2002 Tabata ..... H01R 13/4223 439/752
2003/0220015 A1 * 11/2003 Ishiyama ..... H01R 13/187 439/595
2003/0228793 A1 * 12/2003 Ichida ..... H01R 13/113 439/587
2004/0005821 A1 * 1/2004 Nankou ..... H01R 13/4223 439/752
2005/0095910 A1 * 5/2005 Nishide ..... H01R 13/516 439/595
2005/0196983 A1 * 9/2005 Fujii ..... H01R 13/4223 439/74
2009/0247011 A1 * 10/2009 Myer ..... H01R 13/4365 439/595
2012/0295461 A1 * 11/2012 Hirabayashi ..... H01R 13/113 439/271
2013/0065436 A1 * 3/2013 Hirabayashi ..... H01R 13/113 439/595
2015/0194757 A1 * 7/2015 Osada ..... H01R 13/4223 439/357
2015/0349448 A1 * 12/2015 Kawakami ..... H01R 13/114 439/744
2015/0380853 A1 * 12/2015 Chonan ..... H01R 43/20 439/744

* cited by examiner

CONNECTOR

TECHNICAL FIELD

The present invention relates to a connector, and more particularly to a connector in which the contact pressure between male and female terminals is improved.

BACKGROUND ART

Conventionally, a connector is known which is configured by: a male connector including a male housing, and a male terminal that is inserted into and attached to the male housing; and a female connector including a female housing, and a female terminal that is inserted into and attached to the female housing, and in which the female connector has an elastic lance that is projected from the inner wall of the female housing, and that is engaged with the female terminal, the female terminal has: a tubular socket portion; an elastic-lance engagement hole that is disposed in a tubular wall portion of the socket portion; and an elastic contact piece that is disposed in the socket portion while only one end side is supported by the tubular wall portion of the socket portion, the female terminal is detachably fixed into the female housing by, in the elastic-lance engagement hole, engaging the elastic lance with the tubular wall portion of the socket portion, and, when the male connector and the female connector are fitted to each other, the male terminal is inserted into the socket portion of the female terminal, whereby the elastic contact piece is displaced to be contacted with the male terminal by means of a contact pressure, and an electrical connection between the male and female terminals is obtained (for example, see Patent Literature 1).

PRIOR ART LITERATURE

Patent Literature

[Patent Literature 1] Japanese Patent Application Laid-Open No. 2008-218198

SUMMARY OF THE INVENTION

In the conventional connector, the contact pressure between the male and female terminals is produced by only the contact pressure of the elastic contact piece. When, in order to obtain a larger contact pressure between the male and female terminals, the elastic contact piece is displaced by a longer distance to increase the contact pressure of the elastic contact piece, a stress acting on a root portion of the elastic contact piece is correspondingly increased, and therefore a situation arises where the stress acting on the root portion of the elastic contact piece exceeds the limit, and the elastic contact piece plastically deforms to become unable to return to the original shape, thereby increasing the possibility that the elastic contact piece cannot exert a desired contact pressure. In summary, there is a problem in that the possibility that the elastic contact piece collapses and the contact pressure of the elastic contact piece is lowered is high.

The invention has been conducted in view of the above-discussed problem. It is an object of the invention to provide a connector in which a large contact pressure between male and female terminals is obtained, and an elastic contact piece hardly collapses.

In order to attain the object, a connector of a first invention is a connector which is configured by: a male connector including a male housing, and a male terminal that is inserted into and attached to the male housing; and a female connector including a female housing, and a female terminal that is inserted into and attached to the female housing, and in which the female connector has an elastic lance that is projected from an inner wall of the female housing, and that is to be engaged with the female terminal, the female terminal has: a tubular socket portion; an elastic-lance engagement hole that is disposed in a tubular wall portion of the socket portion; and an elastic contact piece that is disposed in the socket portion while only one end side is supported by the tubular wall portion of the socket portion, the female terminal is detachably fixed into the female housing by, in the elastic-lance engagement hole, engaging the elastic lance with the tubular wall portion of the socket portion, and, when the male connector and the female connector are fitted to each other, the male terminal is inserted into the socket portion of the female terminal, whereby the elastic contact piece is displaced to be contacted with the male terminal by means of a contact pressure, and an electrical connection between the male and female terminals is obtained, wherein the female terminal has an elastic wall portion which is configured by a part of the tubular wall portion of the socket portion, and which is outwardly pressed by the displaced elastic contact piece to be displaced, the elastic lance is disposed on a side of the elastic wall portion of the socket portion so as to be outwardly pressed by the displaced elastic wall portion to be displaced, and the displaced elastic contact piece is pressed by the displaced elastic wall portion and the elastic lance, thereby increasing a contact pressure of the elastic contact piece.

In the connector of the first invention, the female terminal has the elastic wall portion which is configured by a part of the tubular wall portion of the socket portion, and which is outwardly pressed by the displaced elastic contact piece to be displaced, the elastic lance is disposed on the side of the elastic wall portion of the socket portion so as to be outwardly pressed by the displaced elastic wall portion to be displaced, and the displaced elastic contact piece is pressed by the displaced elastic wall portion and the elastic lance, thereby increasing the contact pressure of the elastic contact piece. Therefore, the contact pressure between the male and female terminals is produced by the elastic contact piece, and the elastic wall portion and the elastic lance. When, in order to make the contact pressure between the male and female terminals larger than that obtained by only the elastic contact piece, and increase the contact pressure of the elastic contact piece, a structure which has an auxiliary elastic piece that is disposed in the socket portion while one end side is supported by the tubular wall portion of the socket portion, and that is outwardly pressed by the displaced elastic contact piece to be displaced, and in which the displaced elastic contact piece is pressed by the displaced auxiliary elastic piece is employed, a contact pressure between the male and female terminals which is larger than that produced by the elastic contact piece and the auxiliary elastic piece is obtained. In order to obtain such a large contact pressure between the male and female terminals, it is not necessary to increase the displacement distance of the elastic contact piece. Therefore, the elastic contact piece hardly collapses.

A connector of a second invention is characterized in that, in the connector of the first invention, the elastic lance is to be engaged with the elastic wall portion.

In the connector of the second invention, in accordance with the displacement of the elastic wall portion which is an engaging portion on the side of the female terminal that is to be engaged with the elastic lance on the side of the female housing, also the elastic lance is similarly displaced, and the positional relationship between the two members after the displacement is not changed from that before the displacement. Even when the elastic lance is displaced toward the outer side coincident with the direction in which the lance is detached from the female terminal, and presses the elastic contact piece (increases the contact pressure of the elastic contact piece), therefore, the lance is not detached from the female terminal, and the fixation (locking) of the female terminal is maintained.

A connector of a third invention is characterized in that, in the connector of the second invention, an elastic-lance pressing portion which, when the male connector and the female connector are fitted to each other, is inserted into an elastic-lance escaping space to form a predetermined gap with respect to the elastic lance that is on an inner side is formed in the male housing, the elastic-lance escaping space being formed outside the elastic lance in the female housing in order to allow the elastic lance to be displaced to a position that is deviated from the elastic wall portion, the elastic lance is outwardly pressed by the displaced elastic wall portion to be displaced in the gap, and then butted against the elastic-lance pressing portion.

In the connector of the third invention, in a non-fitted state, the elastic-lance escaping space exists outside the elastic lance, and, when the female terminal is to be detached from the female housing according to the need such as repair, the elastic lance can be displaced to a position where the lance is detached from the female terminal in the elastic-lance escaping space. In a fitted state, by contrast, the elastic-lance pressing portion exists outside the elastic lance through the predetermined gap, the elastic lance is outwardly pressed by the displaced elastic wall portion, and is displaced in the gap, and then the elastic lance is butted against the elastic-lance pressing portion, and is not further displaced outwardly. Therefore, the fixing strength of the female terminal is not lowered.

As described above, the connector of the invention uses the elastic wall portion which is configured by a part of the tubular wall portion of the socket portion in the female terminal, and the elastic lance which, in order to detachably fix the female terminal to the female housing, is projected from the inner wall of the female housing to be engaged with the female terminal. Therefore, the invention can provide a connector in which a large contact pressure between the male and female terminals is obtained, and the elastic contact piece hardly collapses.

DESCRIPTION OF PREFERRED EMBODIMENTS

Hereinafter, an embodiment of the invention will be described with reference to the drawings.

<Whole Configuration>

Figure 1:
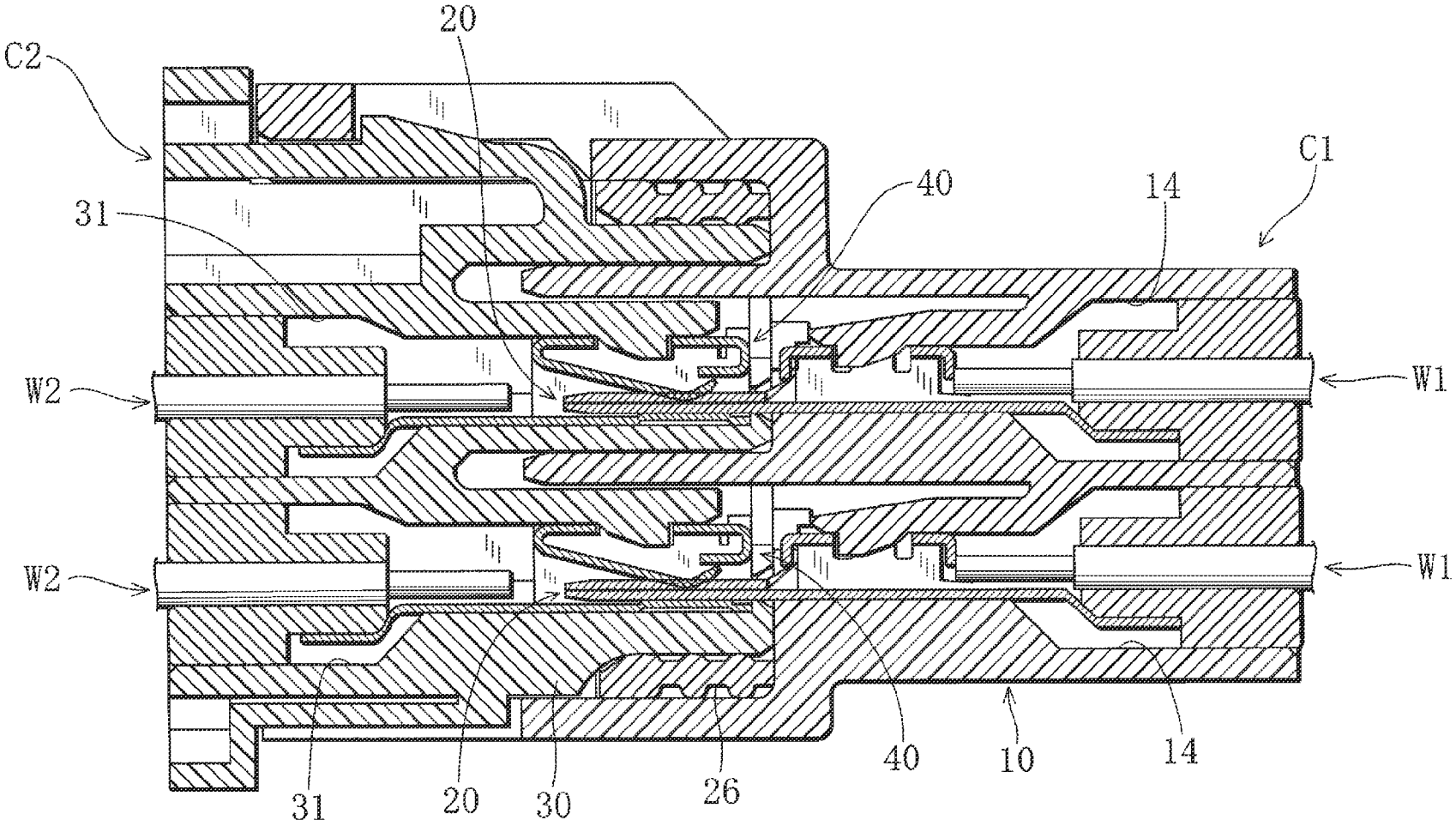
FIG. 1 is a sectional side view showing the whole configuration of a connector of an embodiment of the invention.

As shown in FIG. 1, a connector is configured by: a male connector C1 including a male housing 10, and male terminals 20 that are inserted into and attached to the male housing 10; and a female connector C2 including a female housing 30, and female terminals 40 that are inserted into and attached to the female housing 30.

<Male Connector>

Figure 2:
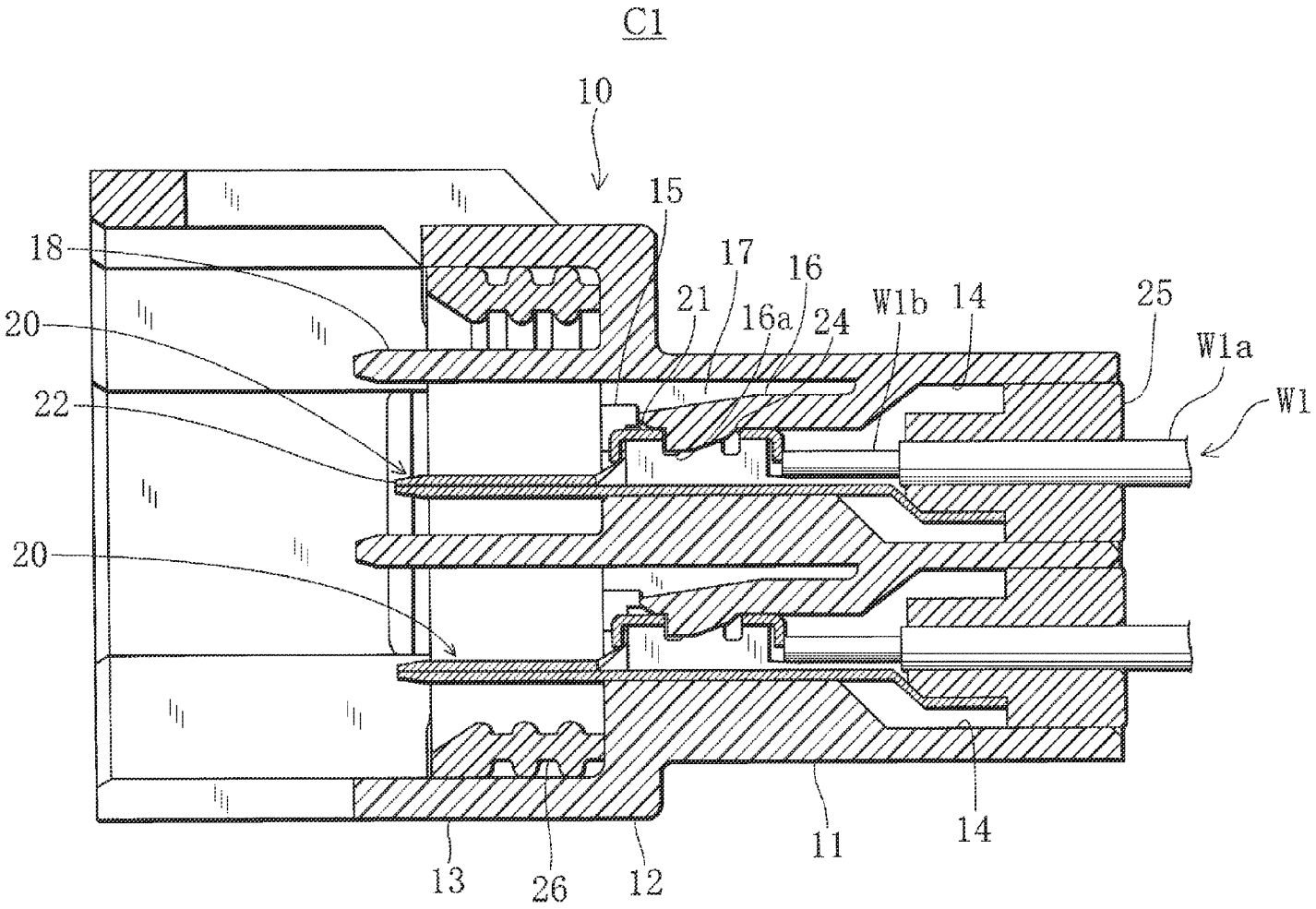
FIG. 2 is a sectional side view showing the whole configuration of a male connector.

As shown in FIG. 2, the male housing 10 is molded by an insulative synthetic resin material, and integrally has a basal portion 11, a rectangular flange portion 12 which outwardly protrudes from a front end portion of the basal portion 11, and a rectangular hood portion 13 which is forwardly projected from an outer side portion of the flange portion 12. When the male connector C1 and the female connector C2 are fitted to each other, the front surface of the basal portion 11 is opposed to that of the female housing 30, and the hood portion 13 is fitted to the outer side of the female housing 30. Terminal accommodating portions 14 into which the male terminal 20 can be inserted from the rear side are formed in the basal portion 11. Each of the terminal accommodating portions 14 is configured by a hole which passes through the front and rear surfaces of the basal portion 11, and communicates with the interior of the hood portion 13. In a front end portion of the terminal accommodating portion 14, a pair of terminal-insertion stoppers 15 which are inwardly projected respectively from both sidewall portions of the front end portion are formed. An elastic lance 16 for detachably fixing the male terminal 20 to the male housing is formed in the terminal accommodating portion 14. The elastic lance 16 is configured by a cantilever which is projected from an upper wall portion of the terminal accommodating portion 14, then bent, and, in a front upper portion in the terminal accommodating portion 14, forwardly extended, and in which the tip end side is vertically elastically displaceable. An engaging projection 16*a* for engaging with the male terminal 20 is formed on the lower surface of the tip end side of the elastic lance. An elastic-lance escaping space 17 for allowing the elastic lance 16 to be elastically displaced to a position where the engaging projection 16*a* of the elastic lance 16 is detached from the male terminal 20 is formed above the elastic lance 16 in the terminal accommodating portion 14.

A rigid and non-bendable pressing portion 18 for an elastic lance 33 which is formed in the female housing 30 is formed in the male housing 10. The elastic-lance pressing portion 18 is projected from the front surface of the basal portion 11 into the hood portion 13 so that, when the male connector C1 and the female connector C2 are fitted to each other, it is inserted into an elastic-lance escaping space 34 which is formed in the female housing 30, and forms a predetermined gap G2 (see FIG. 11) with respect to the elastic lance 33 that is on the lower side.

Figure 3:
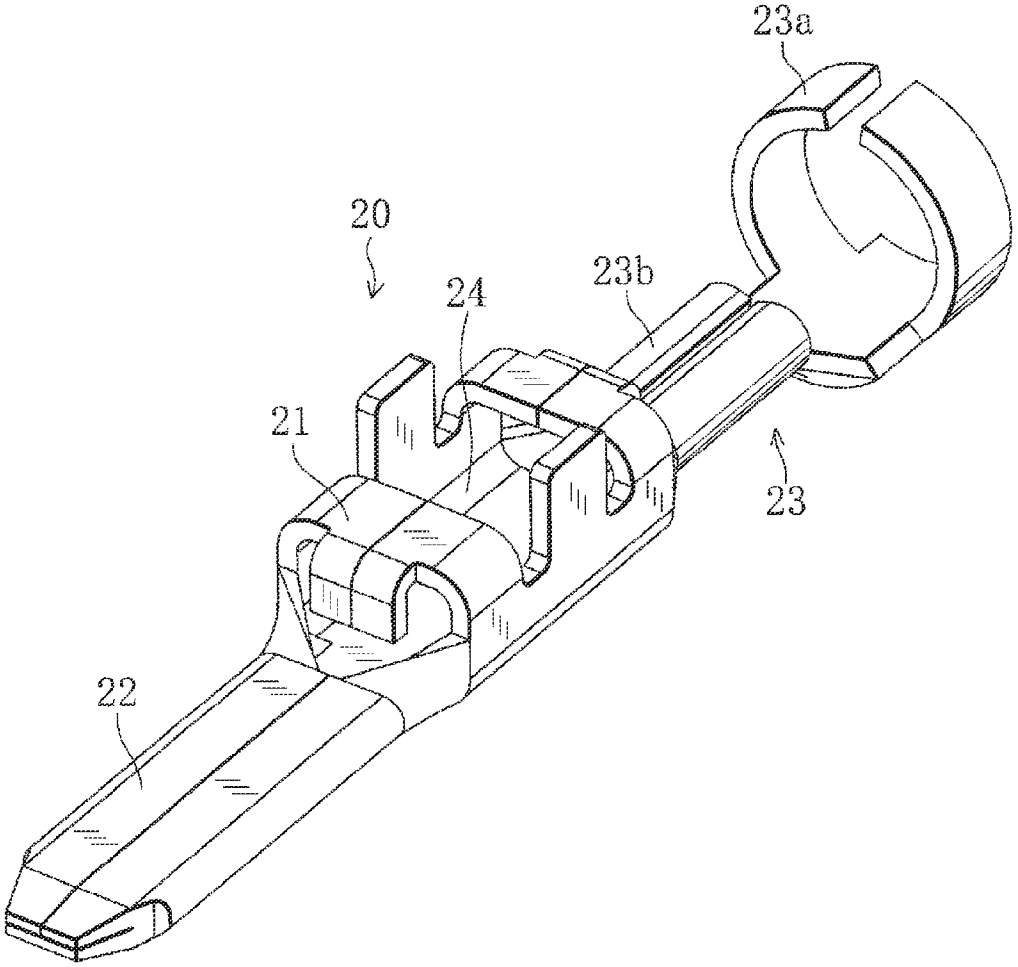
FIG. 3 is a perspective view showing a male terminal.

As shown in FIG. 3, the male terminal 20 is formed by bending one electrically conductive metal piece, and integrally has a rectangular tubular basal portion 21, a flat tab portion (pin contact) 22 which is forwardly projected from the basal portion 21, and a wire connecting portion 23 which is continuous to the rear side of the basal portion 21. An elastic-lance engagement hole 24 is formed in an upper wall portion of the basal portion 21, and a rubber-plug crimping portion 23*a* and a core-wire crimping portion 23*b* are formed in the wire connecting portion 23.

Figure 4:
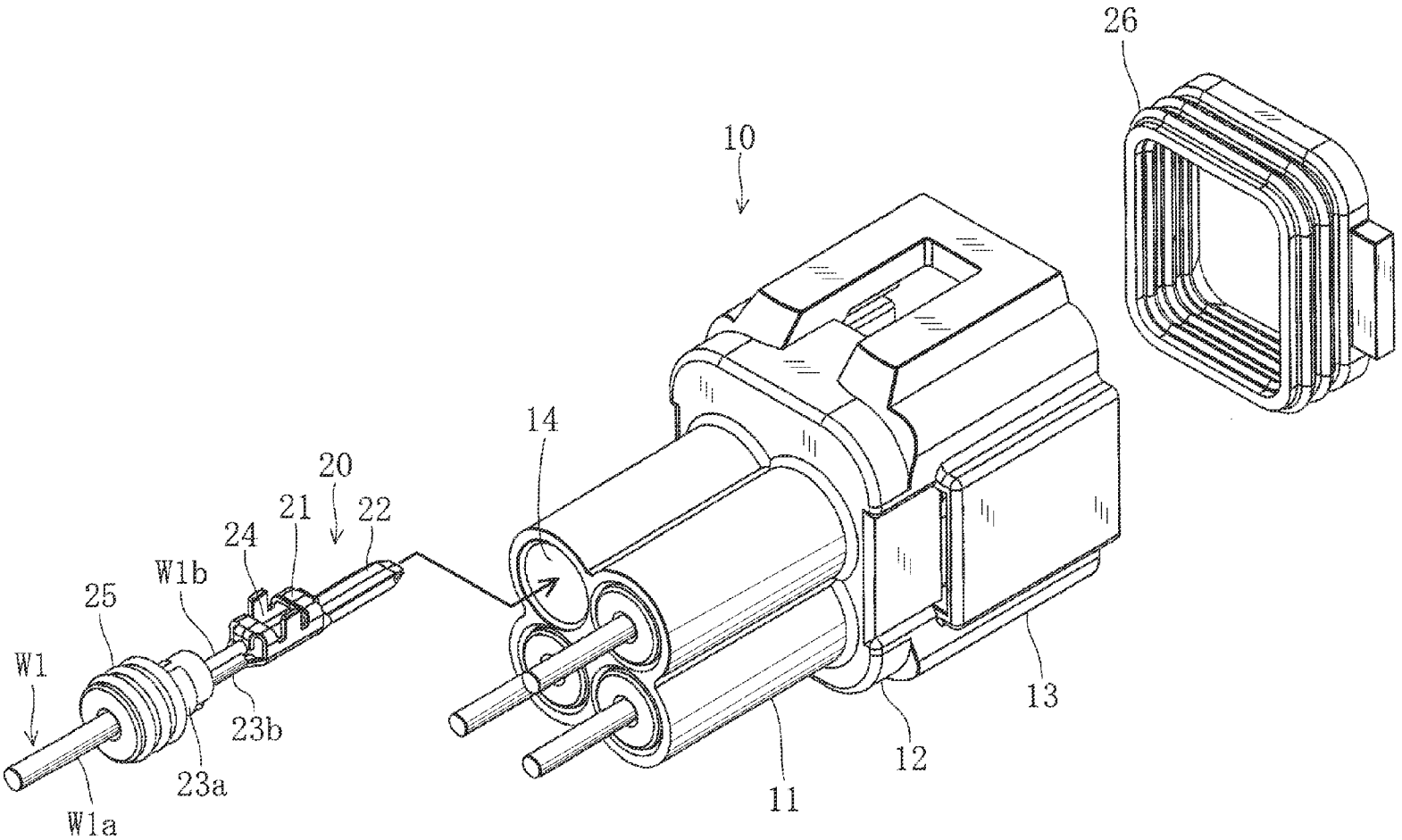
FIG. 4 is a perspective view illustrating assembling of the male connector.

As shown in FIG. 4, when the male connector C1 is to be assembled, first, the male terminal 20 is attached to an electric wire W1, and then the male terminal 20 is inserted from the rear side of the male housing 10 into and attached to the terminal accommodating portion 14. The male terminal 20 is attached to the wire W1 by first fitting a rubber plug 25 which is a wire seal for providing a waterproof property between the male connector C1 and the wire W1, to the outside of an insulation coating W1*a* of the wire W1, and then fixing the rubber plug 25 to the rubber-plug crimping portion 23*a*, and the core wire W1*b* of the wire W1 to the core-wire crimping portion 23*b*. Before the insertion of the male terminal 20 into the terminal accommodating portion 14, a rectangular rubber ring 26 which is a connector seal for providing a waterproof property between the male connector C1 and the female connector C2 is fitted from the front side of the male housing 10 into the hood portion 13.

As shown in FIG. 2, when the male terminal 20 is completely inserted into the terminal accommodating portion 14 until the front end of the basal portion 21 is butted against the terminal-insertion stopper 15 and the terminal cannot be further inserted, the male terminal is inserted into and placed in the male housing 10 in a state where the basal portion 21, the wire connecting portion 23, an end portion of the wire W1, and the rubber plug 25 are accommodated in the terminal accommodating portion 14, and the tab portion 22 is projected into the hood portion 13. When the front end of the basal portion 21 of the male terminal 20 is passed below the elastic lance 16, the engaging projection 16*a* rides over the upper wall portion of the basal portion 21 of the male terminal 20, and therefore the elastic lance 16 is upwardly elastically displaced in the elastic-lance escaping space 17 which is above the elastic lance. At a later timing when the male terminal 20 is completely inserted, an engaging projection 17*a* of the terminal is fitted into the elastic-lance engagement hole 24 of the male terminal 20, whereby the elastic lance is downwardly elastically returned to the original shape. The front surface of the engaging projection 16*a* is engaged with the front end edge (basal portion 31) of the elastic-lance engagement hole 24 of the male terminal 20, thereby lockingly fixing the male terminal 20 to the male housing 10.

In the thus configured male connector C1, the male terminal 20 can be detached from the male housing 10 according to the need such as repair. At this time, a terminal detaching tool which is not shown is inserted from the front side of the male housing 10 into the hood portion 13, the tip end of the tool is engaged with the lower surface of the tip end of the elastic lance 16, the elastic lance 16 is lifted up in the elastic-lance escaping space 17 which is above the elastic lance, the engaging projection 16*a* of the elastic lance 16 is upwardly removed from the elastic-lance engagement hole 24 of the male terminal 20, and the elastic lance 16 is detached from the male terminal 20. In this state, the male terminal 20 can be pulled away toward the rear side of the male housing 10.

<Female Connector>

Figure 5:
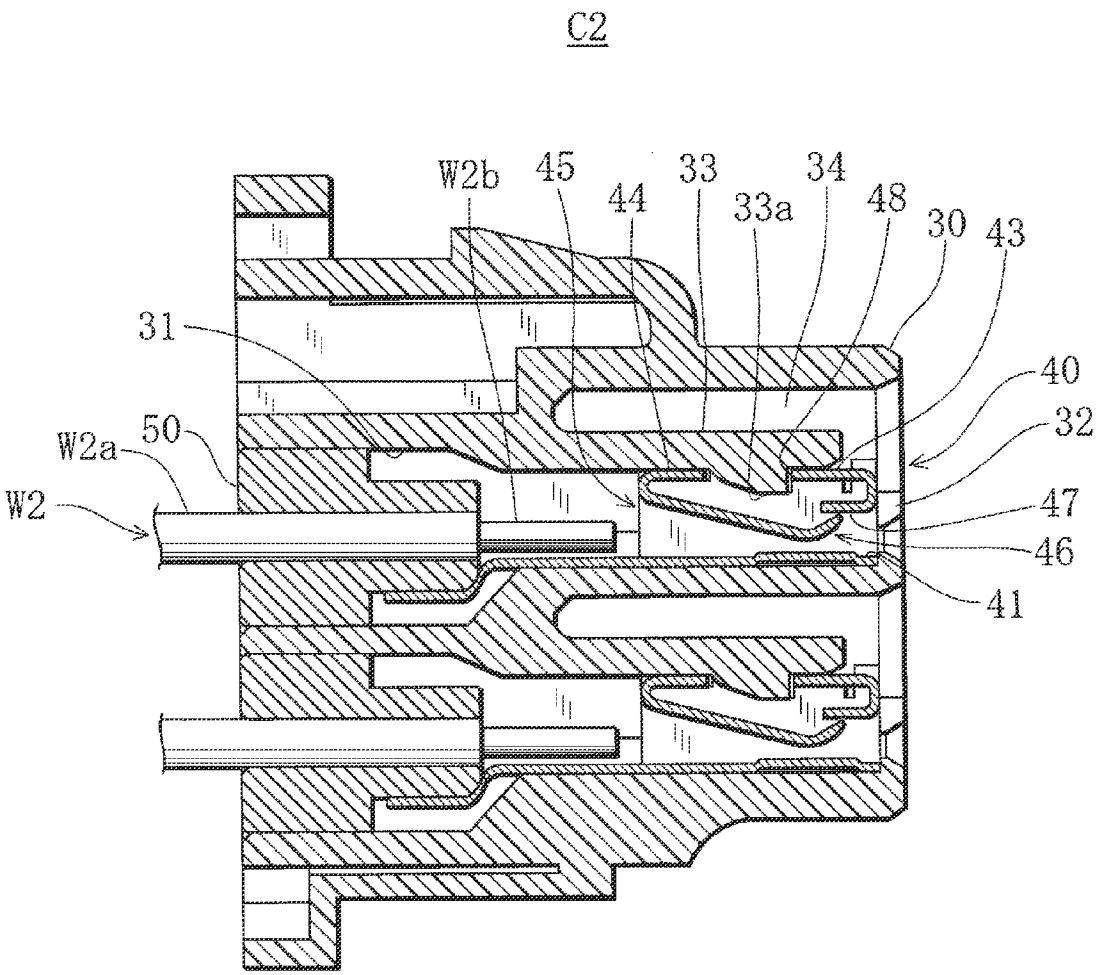
FIG. 5 is a sectional side view showing the whole configuration of a female connector.
Figure 6:
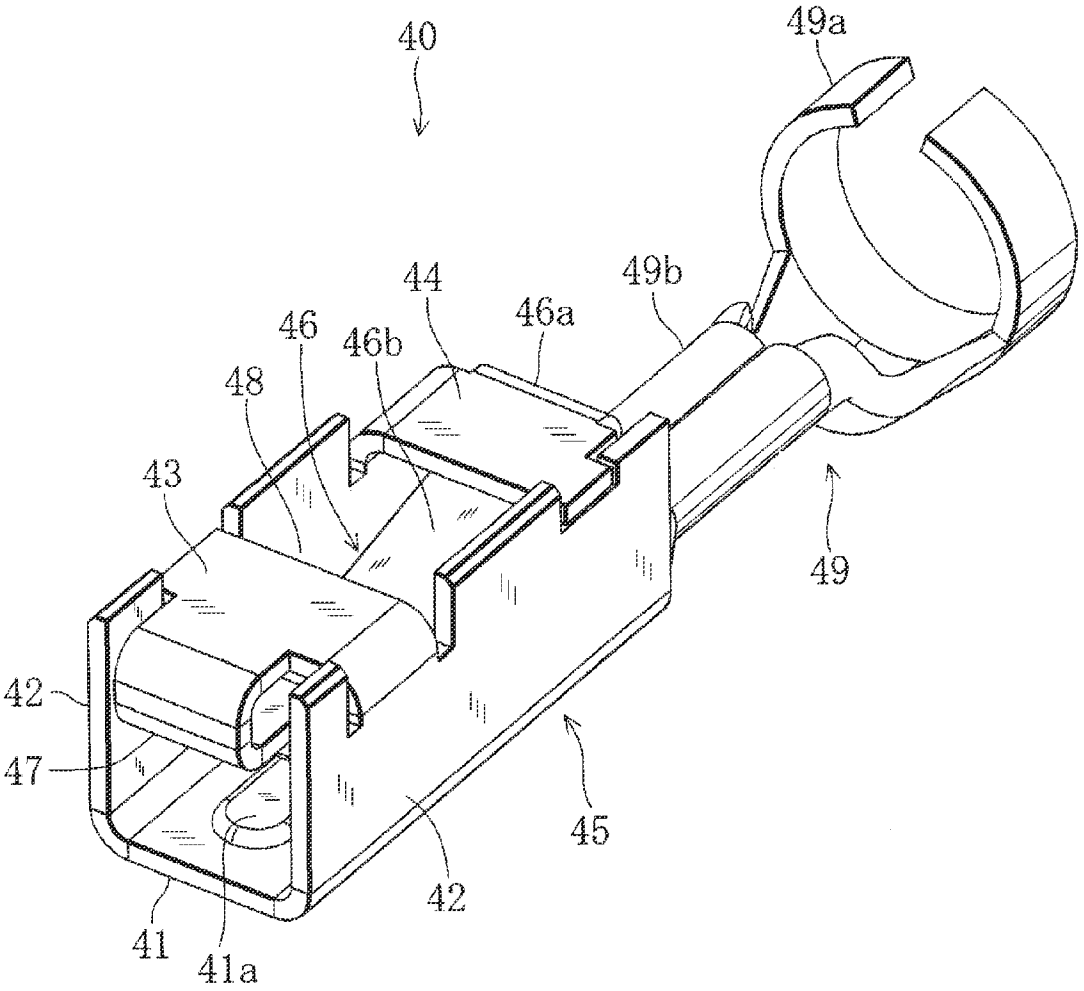
FIG. 6 is a perspective view showing a female terminal.
Figure 7:
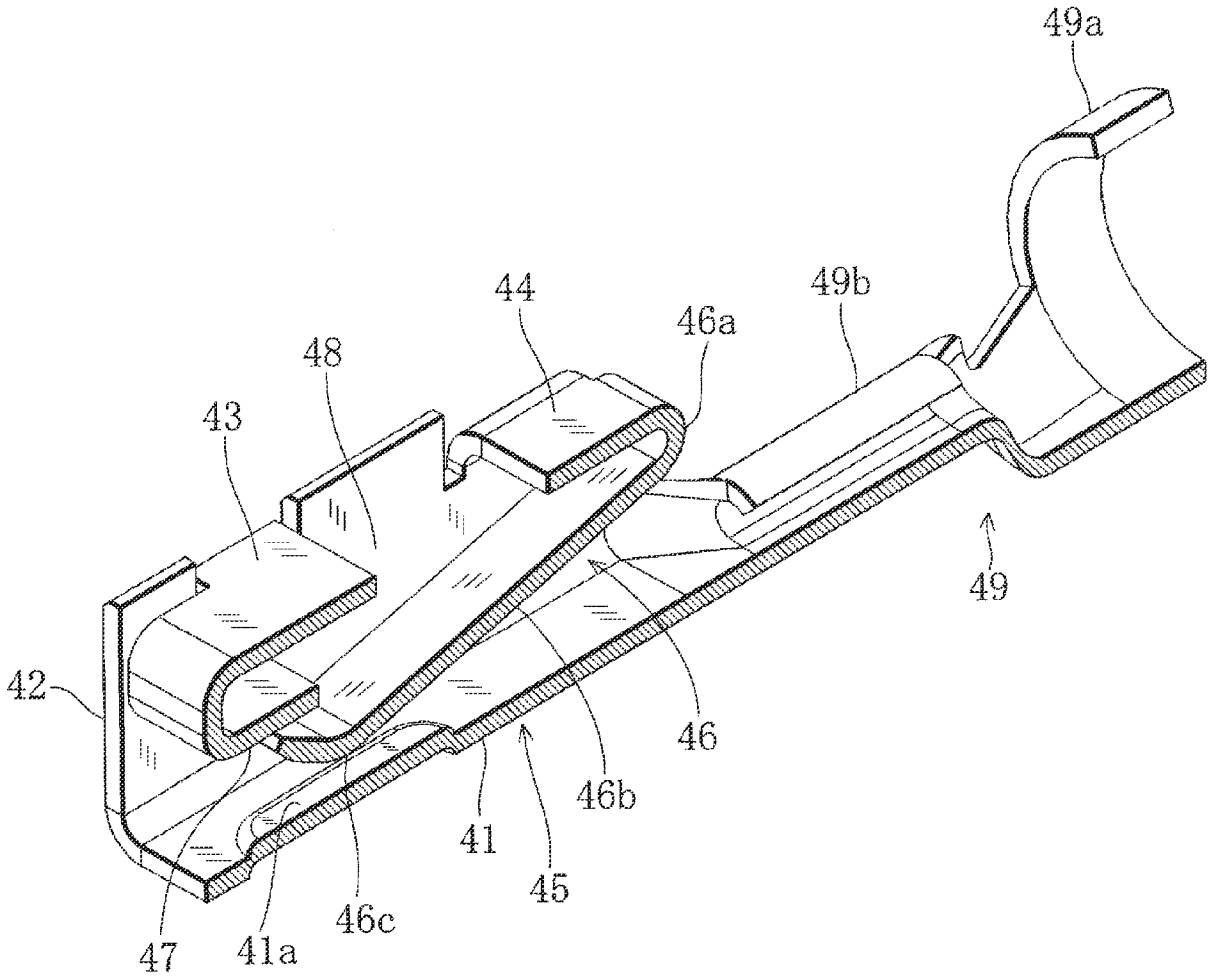
FIG. 7 is a sectional perspective view of the female terminal.
Figure 8B:
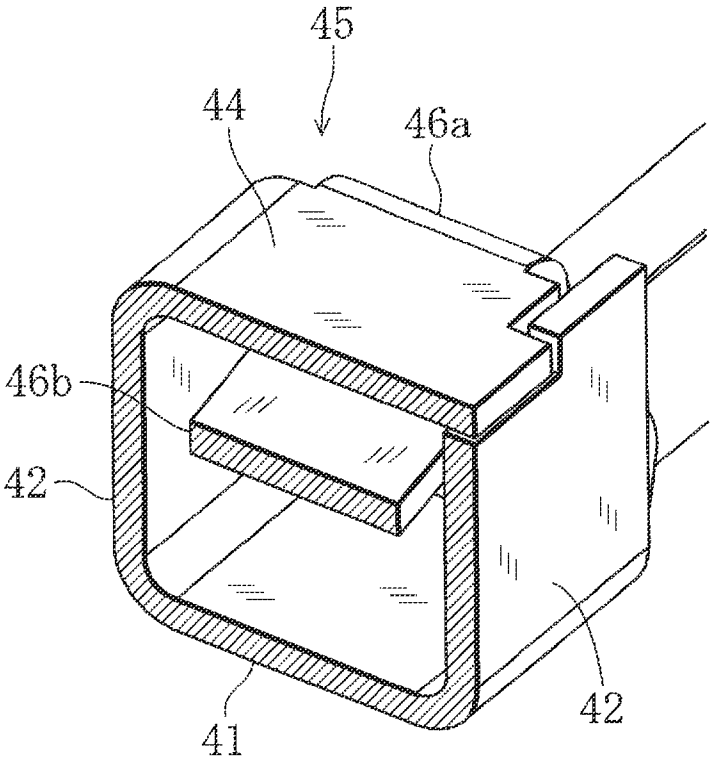
FIG. 8B is a rear sectional perspective view of the socket portion.
Figure 8A:
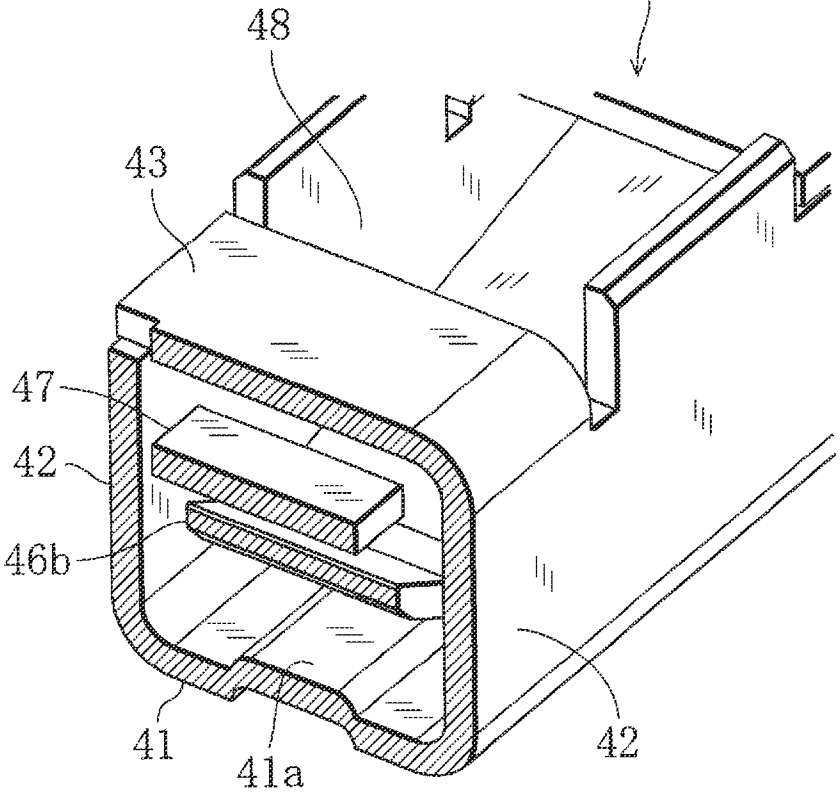
FIG. 8A is a front sectional perspective view of a socket portion.

As shown in FIG. 5, the female housing 30 is molded by an insulative synthetic resin material. When the male connector C1 and the female connector C2 are fitted to each other, the front surface of the female housing is opposed to that of the basal portion 11 of the male housing 10, and the female housing except a rear end portion is fitted into the inside of the hood portion 13 of the male housing 10. Terminal accommodating portions 31 into which female terminals 40 can be inserted from the rear side are formed in the female housing 30. Each of the terminal accommodating portions 31 is configured by a hole which passes through the front and rear surfaces of the female housing 30. In a front end portion of the terminal accommodating portion 31, a pair of terminal-insertion stoppers which are inwardly projected respectively from both sidewall portions of the front end portion are formed. An elastic lance 33 for detachably fixing the female terminal to the female housing 30 is formed in the terminal accommodating portion 31. The elastic lance 33 is configured by a cantilever which is projected from an upper wall portion of the terminal accommodating portion 31, then bent, and, in a front upper portion in the terminal accommodating portion 31, forwardly extended, and in which the tip end side is vertically elastically displaceable. An engaging projection 33*a* for engaging with the female terminal 40 is formed on the lower surface of the tip end side of the elastic lance. The elastic-lance escaping space 34 for allowing the engaging projection 33*a* of the elastic lance 33 to elastically displace the elastic lance 33 to a position where the engaging projection 33*a* of the elastic lance 33 is detached from the female terminal 40 is formed above the elastic lance 33 in the terminal accommodating portion 31. When the male connector C1 and the female connector C2 are fitted to each other, the elastic-lance pressing portion 18 formed in the male housing 10 can be inserted from front side into the elastic-lance escaping space 34, and the predetermined gap G2 (see FIG. 11) is formed between the inserted elastic-lance pressing portion 18 and the elastic lance 33 which is below the portion.

As shown in FIGS. 6 to 8B, the female terminal 40 is formed by bending one electrically conductive metal piece, and integrally has a rectangular tubular socket portion 45 into which the tab portion 22 of the male terminal 20 can be inserted from the front side, and an elastic contact piece 46. The socket portion 45 has: a bottom wall portion 41 on the side of the tip end; side wall portions 42, 42 which are raised from both side portions of the bottom wall portion 41, respectively; and front and rear upper wall portions 43, 44 which are formed by inwardly bending extended portions that are upwardly extended from a front portion of one of the side wall portions 42, and a rear portion of the other side wall portion 42, respectively, and not by fixing but by only engaging their tip end portions with the side wall portions 42 on the opposite sides, respectively. The elastic contact piece 46 is configured by a cantilever which is formed by folding back an extended portion that is rearwardly extended from the rear upper wall portion 44, toward the front side of the socket portion 45, and in which the tip end side is vertically elastically displaceable. In the front portion where the bottom wall portion 41 is opposed to the front upper wall portion 43, a stationary contact portion 41*a* which protrudes into the socket portion 45 is formed by punching out. The elastic contact piece 46 has: a bent portion 46*a* which is folded back from the rear upper wall portion 44; an arm portion 46*b* which is extended obliquely forwardly and downwardly from the bent portion 46*a*, and in which the tip end side is placed between the front upper wall portion 43 and the stationary contact portion 41*a*; and a movable contact portion 46*c* which is formed by bending obliquely upwardly the tip end side of the arm portion 46*b*, into an arcuate surface that is opposed to the stationary contact portion 41*a*, and that is downwardly projected. A male-terminal insertion gap G1 (see FIG. 10) which is smaller than the thickness of the tab portion 22 of the male terminal 20 is formed between the stationary contact portion 41*a* and the movable contact portion 46*c*. When the male connector C1 and the female connector C2 are fitted to each other, the tab portion 22 of the male terminal 20 is inserted from the front side into the male-terminal insertion gap G1 in the tubular socket portion 45 to cause the tip end side of the elastic contact piece 46 to be upwardly displaced, whereby the movable contact portion 46*c* is contacted with the upper surface of the tab portion 22 of the male terminal 20 by means of a contact pressure. As a result, the tab portion 22 of the male terminal 20 is clampingly held between the stationary contact portion 41*a* and the movable contact portion 46*c*, and the male terminal 20 and the female terminal 40 are electrically connected to each other.

A tip end portion of a rigid contact piece 47 which is formed by downwardly bending an extended portion that is forwardly extended from the front upper wall portion 43, and then folding back toward the rear side of the interior of the socket portion 45 is placed between the front upper wall portion 43 and the tip end of the elastic contact piece 46. The tip end of the elastic contact piece 46 which is upwardly displaced is butted against a tip end portion of the rigid contact piece 47, the front upper wall portion 43 which supports the rigid contact piece 47 is upwardly pressed to be displaced, and the elastic contact piece 46 which is upwardly displaced is downwardly pressed by the front upper wall portion 43 which is upwardly displaced, whereby the contact pressure of the elastic contact piece 46 is increased. Namely, the female terminal 40 has the front upper wall portion 43 which is configured by a part of a tubular wall portion of the socket portion 45, as an elastic wall portion which is upwardly pressed and displaced by the elastic contact piece 46 that is upwardly displaced, which downwardly presses the displaced elastic contact piece 46, and which increases the contact pressure of the elastic contact piece 46 (hereinafter, "front upper wall portion" is referred to as "elastic wall portion").

In the rear upper wall portion 44 which supports the elastic contact piece 46, even in the configuration where, in a similar manner as the elastic wall portion 43, the tip end side of the rear upper wall portion is only engaged with the one side wall portion 42, and not fixed thereto, the rear upper wall portion is not upwardly displaced when the tip end side of the elastic contact piece 46 is upwardly pressed by the tab portion 22 of the male terminal 20, and the contact pressure exerted by only the elastic contact piece 46 is not lowered. However, the tip end side of the rear upper wall portion 44 may be fixed to the one sidewall portion 42.

An elastic-lance engagement hole 48 which is configured by a gap between the elastic wall portion 43 and the rear upper wall portion 44 is disposed in the socket portion 45.

The female terminal 40 integrally has a wire connecting portion 49. The wire connecting portion 49 is continuous to the rear side of the socket portion 45, and a rubber-plug crimping portion 49*a* and a core-wire crimping portion 49*b* are formed.

Figure 9:
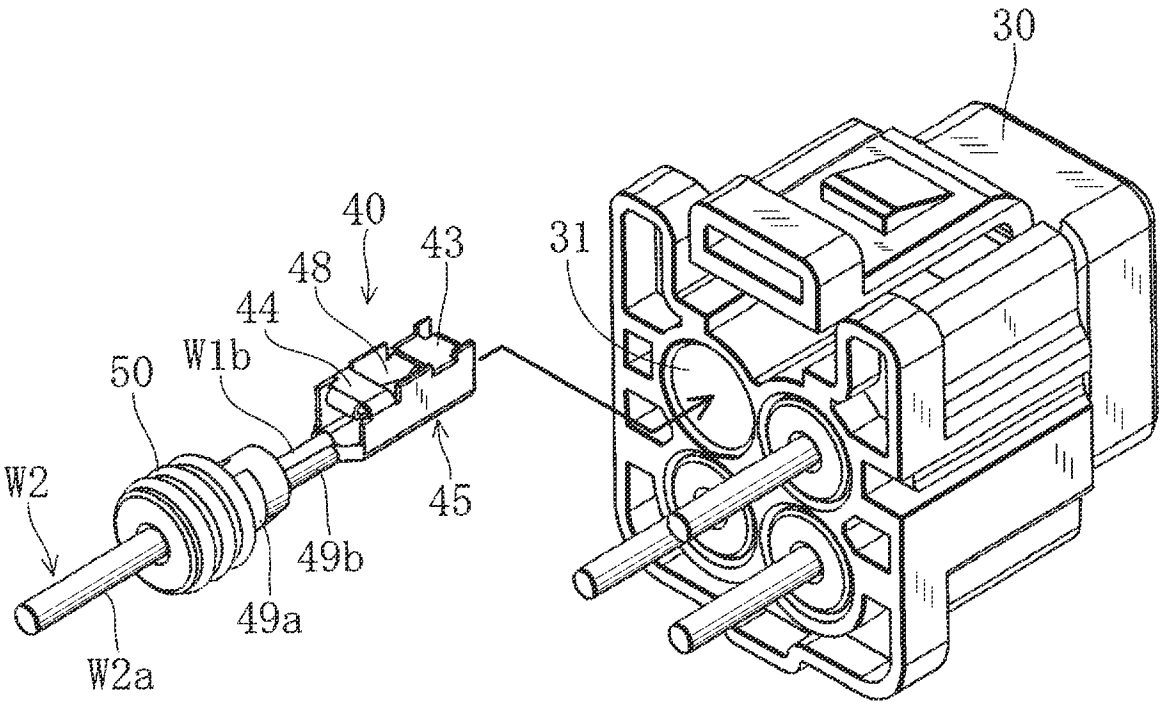
FIG. 9 is a perspective view illustrating assembling of the female connector.

As shown in FIG. 9, when the female connector C2 is to be assembled, first, the female terminal 40 is attached to an electric wire W2, and then the female terminal 40 is inserted from the rear side of the female housing 30 into and attached to the terminal accommodating portion 31. When the female terminal 40 is to be attached to the wire W2, first, a rubber plug 50 which is a wire seal for providing a waterproof property between the female connector C2 and the wire W2 is fitted to the outside of an insulation coating W2*a* of the wire W2. Then, the rubber plug 50 is fixed to the rubber-plug crimping portion 49*a*, and the core wire W2*b* of the wire W2 is fixed to the core-wire crimping portion 49*b*.

As shown in FIG. 5, when the female terminal 40 is completely inserted into the terminal accommodating portion 31 until the front end of the socket portion 45 is butted against the terminal-insertion stopper 32 and the terminal cannot be further inserted, the female terminal is inserted into and placed in the female housing 30 in a state where the socket portion 45, the wire connecting portion 49, an end portion of the wire W2, and the rubber plug 50 are accommodated in the terminal accommodating portion 31. When the front end of the socket portion 45 of the female terminal 40 is passed below the elastic lance 33, the engaging projection 33*a* rides over the elastic wall portion 43 of the socket portion 45 of the female terminal 40, and therefore the elastic lance 33 is upwardly elastically displaced in the elastic-lance escaping space 34 which is above the elastic lance. At a later timing when the female terminal 40 is completely inserted, the engaging projection 33*a* of the terminal is fitted into the elastic-lance engagement hole 48 of the female terminal 40, whereby the elastic lance is downwardly elastically returned to the original shape. The front surface of the engaging projection 33*a* is engaged with the front end edge of the elastic-lance engagement hole 48 of the female terminal 40, i.e., the rear end surface of the elastic wall portion 43, thereby lockingly fixing the female terminal 40 to the female housing 30.

The elastic lance 33 is disposed on the side of the elastic wall portion 43 of the socket portion 45 so as to be upwardly pressed and displaced by the elastic wall portion 43 which is upwardly displaced. Specifically, the tip end side of the elastic lance 33 is superimposed on the elastic wall portion 43. More specifically, a tip end portion which is more forward than the engaging projection 33*a* of the elastic lance 33 is superimposed on the elastic wall portion 43, the elastic wall portion 43 which is upwardly displaced is butted against the elastic lance 33, the elastic lance 33 is upwardly pressed to be displaced, and the elastic contact piece 46 which is upwardly displaced is downwardly pressed by the elastic wall portion and elastic lance 33 which are upwardly displaced, whereby the contact pressure of the elastic contact piece 46 is increased. In other words, in the tubular wall portion of the rigid socket portion 45, a part of the tubular wall portion with which the elastic lance 33 is engaged is configured as the elastic wall portion 43 which is outwardly pressed and displaced by the displaced elastic contact piece 46, and not only the elastic wall portion 43 but also the elastic lance 33 are used as a spring for increasing the contact pressure of the elastic contact piece 46.

In the thus configured female connector C2, the female terminal 40 can be detached from the female housing 30 according to the need such as repair. At this time, a terminal detaching tool which is not shown is inserted from the front side of the female housing 30 into the terminal accommodating portion 31, the tip end of the tool is engaged with the lower surface of the tip end of the elastic lance 33, the elastic lance 33 is lifted up in the elastic-lance escaping space 34 which is above the elastic lance, the engaging projection 33*a* of the elastic lance 33 is upwardly removed from the elastic-lance engagement hole 48 of the female terminal 40, and the elastic lance 33 is detached from the female terminal 40. In this state, the female terminal 40 can be pulled away toward the rear side of the female housing 30.

Function of Embodiment

Next, the function of the embodiment will be described with reference to FIGS. 10 to 13.

Figure 10:
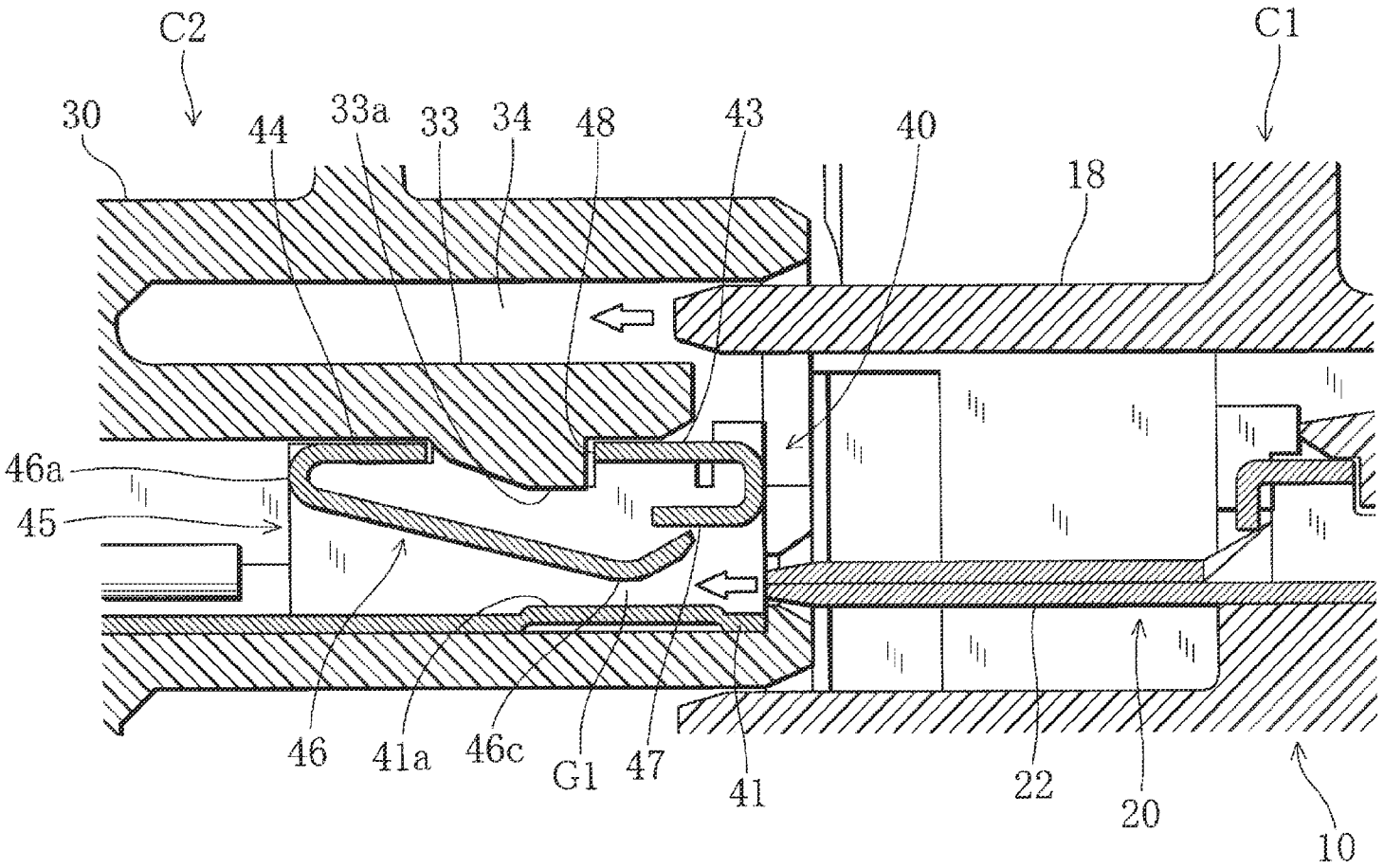
FIG. 10 is a partial enlarged sectional side view showing a first (initial) step of a flow of producing a contact pressure between the male and female terminals.
Figure 11:
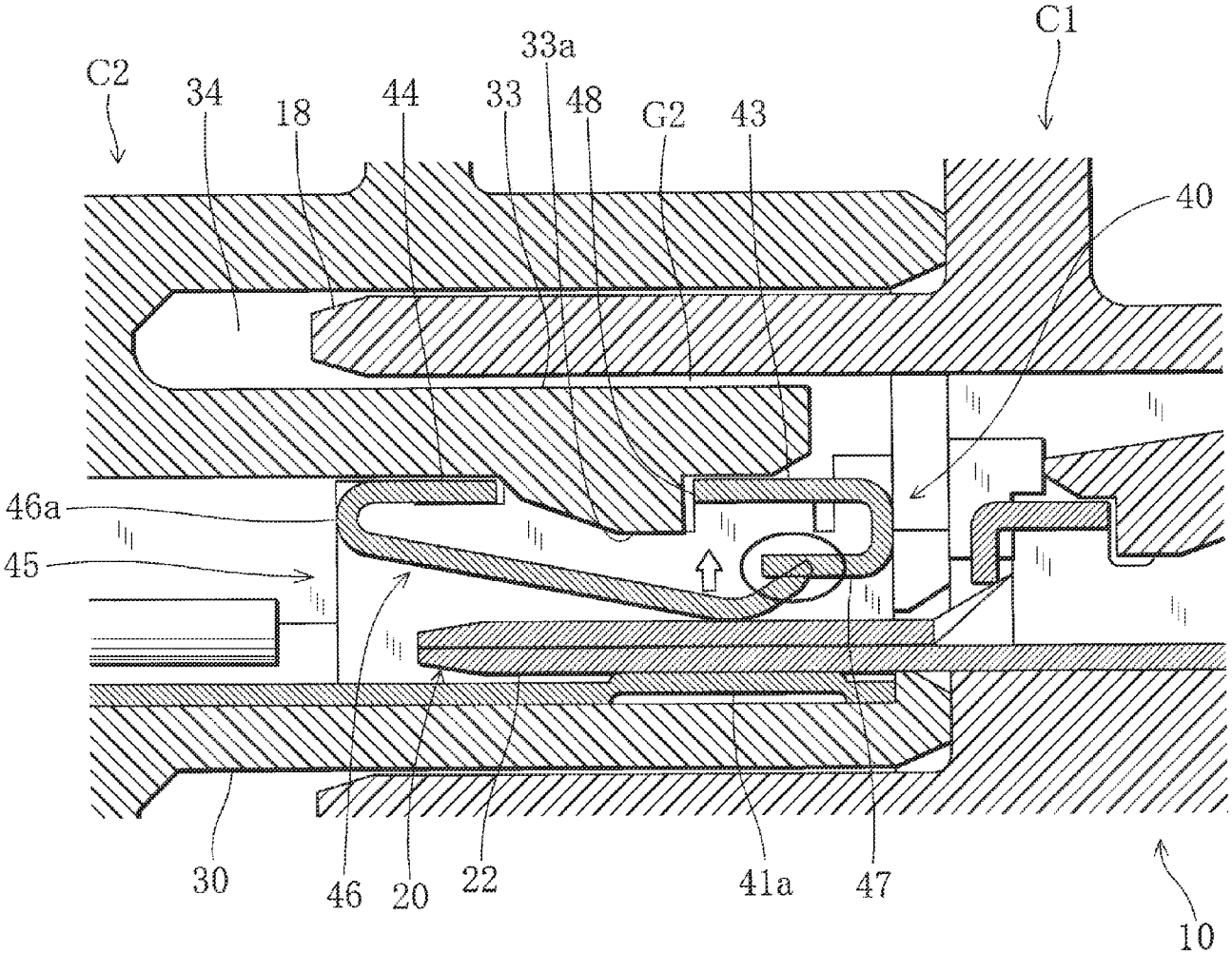
FIG. 11 is a partial enlarged sectional side view showing a second step of the flow of producing the contact pressure between the male and female terminals.
Figure 12:
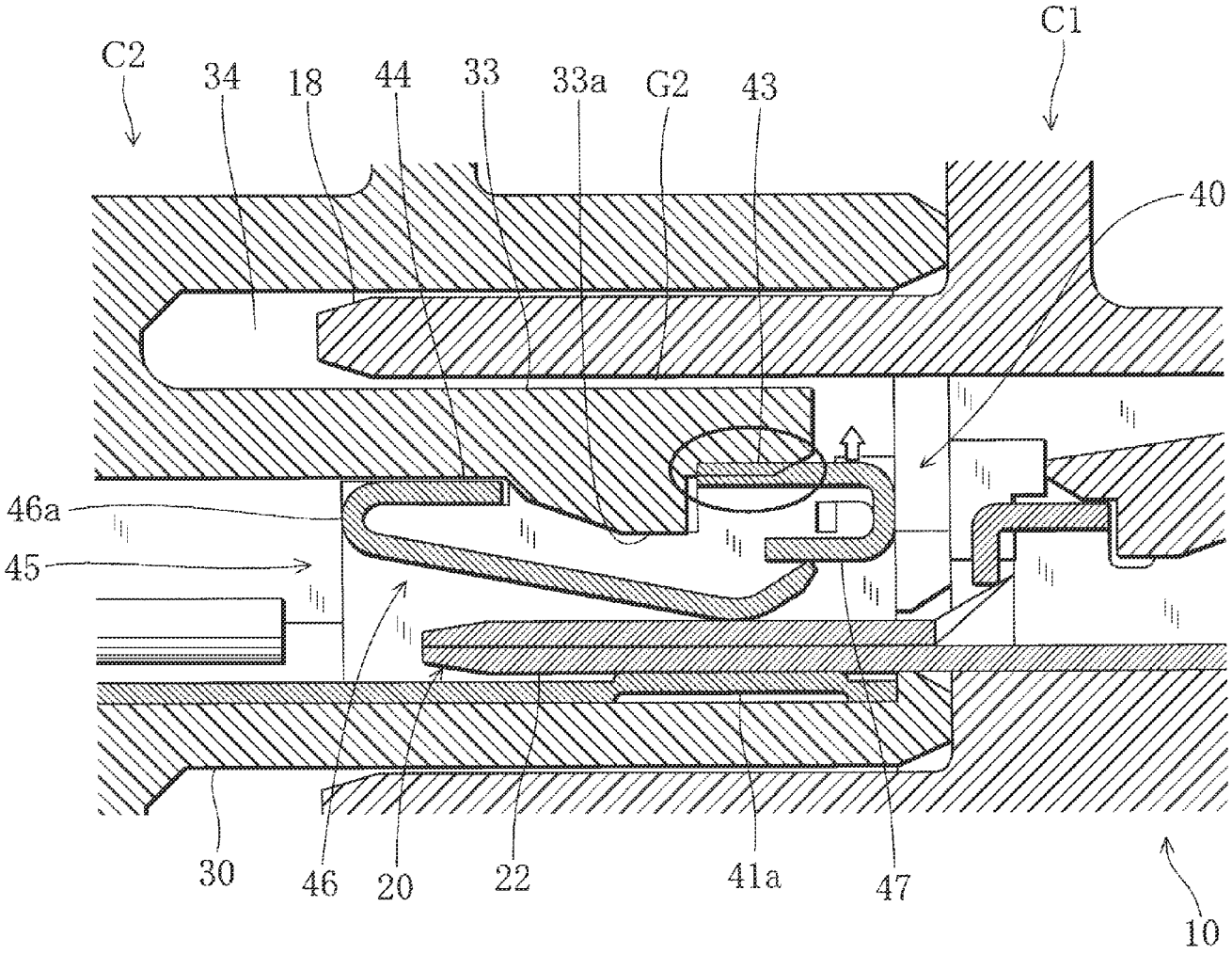
FIG. 12 is a partial enlarged sectional side view showing a third step of the flow of producing the contact pressure between the male and female terminals.
Figure 13:
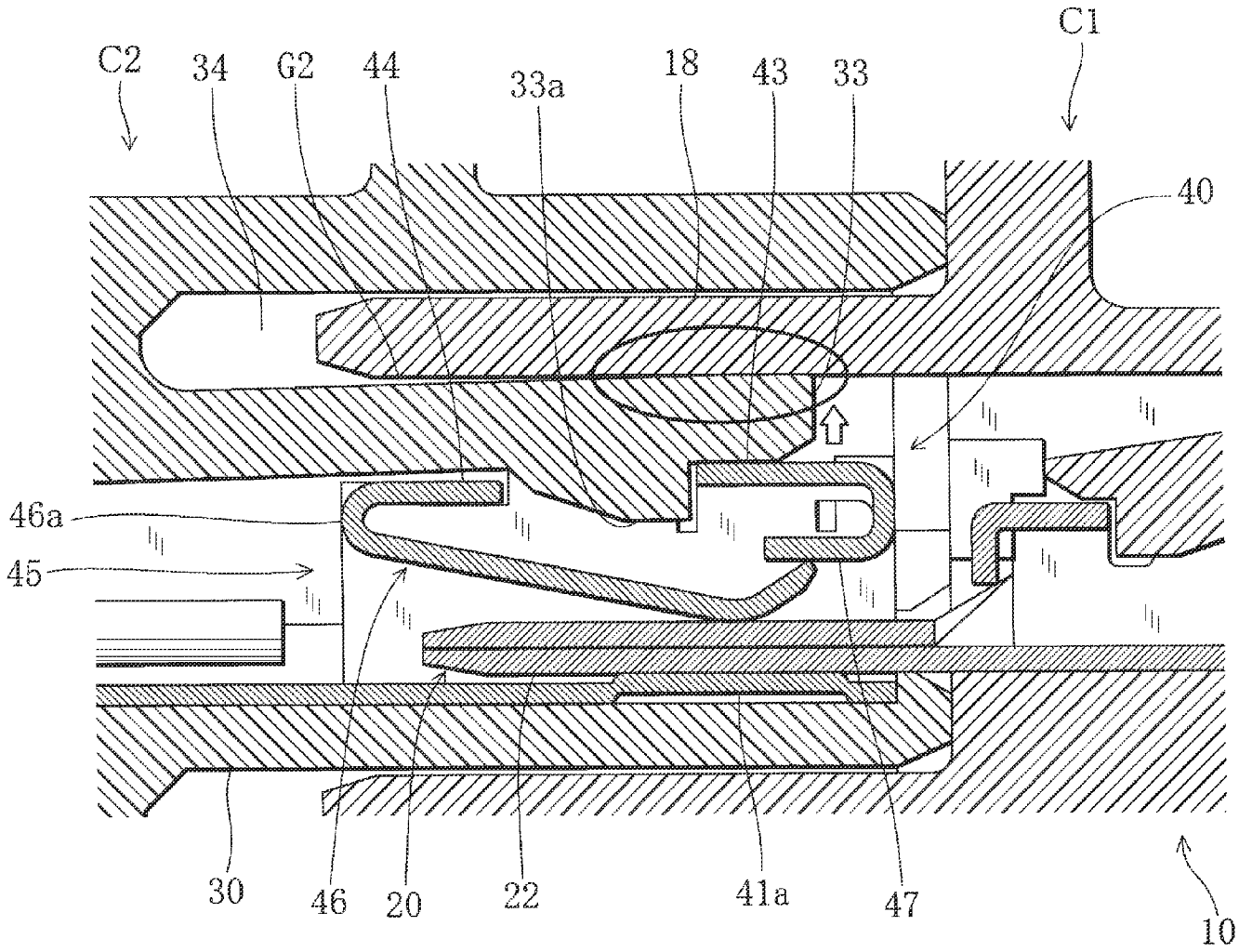
FIG. 13 is a partial enlarged sectional side view showing a fourth (final) step of the flow of producing the contact pressure between the male and female terminals.

When the fitting of the male connector C1 and the female connector C2 is started, first, the elastic-lance pressing portion 18 of the male housing 10 is inserted from the front side into the elastic-lance escaping space 34 of the female housing 30 as shown in FIG. 10, and the tab portion 22 of the male terminal 20 is inserted from the front side into the male-terminal insertion gap G1 between the stationary contact portion 41*a* of the bottom wall portion 41 in the socket portion 45 of the female terminal 40, and the movable contact portion 46*c* of the elastic contact piece 46. As shown in FIG. 11, in accordance with the insertion of the elastic-lance pressing portion 18 into the elastic-lance escaping space 34, then, the predetermined gap G2 is formed with respect to the elastic lance 33 which is on the lower side. By contrast, the tip end side of the elastic contact piece 46 is upwardly pressed to be displaced in accordance with the insertion of the tab portion 22, and the tip end of the piece is butted against the rigid contact piece 47. As shown in FIG. 12, then, the elastic wall portion 43 is upwardly pressed through the rigid contact piece 47 to be displaced. The elastic wall portion 43 which is upwardly displaced downwardly presses the elastic contact piece 46 which is upwardly displaced, through the rigid contact piece 47, and therefore the contact pressure with respect to the tab portion 22 of the elastic contact piece 46 is increased. As shown in FIG. 12, moreover, the elastic wall portion 43 which is upwardly displaced is butted against the tip end side of the elastic lance 33. As shown in FIG. 13, then, the tip end side of the elastic lance 33 is upwardly pressed to be upwardly displaced in the gap G2 with respect to the elastic-lance pressing portion 18 which is on the upper side. Thereafter, the tip end side of the elastic lance 33 is butted against the elastic-lance pressing portion 18. The elastic lance 33 which is upwardly displaced downwardly presses the elastic contact piece 46 which is upwardly displaced, through the elastic wall portion 43 and the rigid contact piece 47, and therefore the contact pressure with respect to the tab portion 22 of the elastic contact piece 46 is further increased. As a result, a contact pressure between the male and female terminals which is larger than that in the conventional art is produced by the elastic contact piece (metal spring) 46, and the elastic wall portion (metal spring) 43 and the elastic lance (resin spring) 33. In order to obtain such a large contact pressure between the male and female terminals, it is not necessary to increase the displacement distance of the elastic contact piece 46, and therefore the elastic contact piece 46 hardly collapses.

In the embodiment, in accordance with the displacement of the elastic wall portion 43 which is an engaging portion that is to be engaged with the elastic lance 33 on the side of the female housing 30, and that is on the side of the female terminal 40, as shown in FIG. 13, also the elastic lance 33 is similarly displaced, and the positional relationship between the two members after the displacement is not changed from that before the displacement. Even when the elastic lance 33 is displaced toward the upper side coincident with the direction in which the lance is detached from the female terminal 40, and presses the elastic contact piece 46 (increases the contact pressure of the elastic contact piece 46), therefore, the lance is not detached from the female terminal 40, and the fixation (locking) of the female terminal 40 is maintained. In a non-fitted state, as shown in FIG. 5, the elastic-lance escaping space 34 exists above the elastic lance 33, and, when the female terminal 40 is to be detached from the female housing 30 according to the need such as repair, the elastic lance 33 can be displaced to a position where the lance is detached from the female terminal 40 in the elastic-lance escaping space 34. As shown in FIGS. 11 and 12, in a fitted state, by contrast, the elastic-lance pressing portion 18 exists above the elastic lance 33 through the predetermined gap G2, the elastic lance 33 is upwardly pressed by the displaced elastic wall portion 43, and is displaced in the gap G2 as shown in FIG. 13, and then the elastic lance 33 is butted against the elastic-lance pressing portion 18, and is not further displaced toward the outside. Therefore, the fixing strength of the female terminal 40 is not lowered.

In the embodiment, as described above, the elastic wall portion 43 which is configured by a part of the tubular wall portion of the socket portion 45 in the female terminal 40, and the elastic lance 33 which, in order to detachably fix the female terminal 40 to the female housing 30, is projected from the inner wall of the female housing 30 to be engaged with the female terminal 40 are used, and therefore it is possible to realize a connector in which a large contact pressure between the male and female terminals is obtained, and the elastic contact piece 26 hardly collapses.

Other Embodiments

Although the embodiment of the invention has been described, the invention is not limited to this, and may be implemented while variously modified without departing from the spirit of the invention. In the embodiment, a multipolar connector, specifically, a four-pole connector for connecting automobile wire harnesses to each other is used, the connector has the four male terminals, and the four female terminals in accordance with the number of electrodes (number of wires to be connected), and, also with respect to the terminal accommodating portions of each of the male and female housings, and the elastic-lance pressing portions of the male housing, four portions are formed in accordance with the number of electrodes. The invention may be applied to various connectors such as a monopolar connector for connecting one electric wire to one electric wire, and a connector for connecting electric wires to a device board (electric or electronic device).

In the embodiment, the elastic lance is engaged from the upper side with the socket portion, and therefore a part of the upper wall portion of the socket portion is configured as the elastic wall portion. In a configuration where the elastic lance is engaged from a lateral side or the lower side, alternatively, a part of a side or bottom wall portion with which the elastic lance is to be engaged may be configured as the elastic wall portion. In the embodiment, the elastic contact piece is folded back from the rear upper wall portion (rear end) of the socket portion, and therefore the front upper wall portion (front portion) of the socket portion is configured as the elastic wall portion. In a configuration where the elastic contact piece is folded back from the front upper wall portion (front portion) of the socket portion, alternatively, the rear upper wall portion (rear end) of the socket portion may be configured as the elastic wall portion. Although, in the embodiment, the elastic contact piece is formed integrally with the socket portion, a configuration where a metal plate spring which is separately formed, or the like is fixed to the inner wall of the socket portion may be employed. In the embodiment, the structure where the tip end of the elastic contact piece is butted against the rigid contact piece formed on the elastic wall portion, thereby displacing the elastic wall portion is employed. Alternatively, the invention may be applied also to a structure where the tip end of the elastic contact piece is directly butted against the elastic wall portion, thereby displacing the elastic wall portion.

DESCRIPTION OF REFERENCE NUMERALS

C1 male connector
C2 female connector
10 male housing
18 elastic-lance pressing portion
20 male terminal
30 female housing
33 elastic lance
40 female terminal
45 socket portion
43 elastic wall portion
46 elastic contact piece
48 elastic-lance engagement hole

The invention claimed is:

1. A connector comprising:

a male connector including a male housing, and a male terminal that is inserted into and attached to the male housing; and a female connector including a female housing, and a female terminal that is inserted into and attached to the female housing, and in which the female connector has an elastic lance that is projected from an inner wall of the female housing, and that is to be engaged with the female terminal, the female terminal has:

a tubular socket portion;

an elastic-lance engagement hole that is disposed in a tubular wall portion of the socket portion; and an elastic contact piece that is disposed in the socket portion while one end side is supported by the tubular wall portion of the socket portion, the female terminal is detachably fixed into the female housing by, in the elastic-lance engagement hole, engaging the elastic lance with the socket portion, and, when the male connector and the female connector are fitted to each other, the male terminal is inserted into the socket portion of the female terminal, whereby the elastic contact piece is displaced to be contacted with the male terminal by means of a contact pressure to electrically connect the male terminal and the female terminal to each other, wherein the female terminal has an elastic wall portion which is configured by a part of the tubular wall portion of the socket portion, and which is outwardly pressed by the displaced elastic contact piece, the elastic lance is disposed on a side of the elastic wall portion of the socket portion so as to be outwardly pressed by the displaced elastic wall portion, and the displaced elastic contact piece is pressed by the displaced elastic wall portion and the elastic lance, thereby increasing the contact pressure of the elastic contact piece with the male terminal, wherein the elastic lance is to be engaged with the elastic wall portion, wherein an elastic-lance pressing portion which, when the male connector and the female connector are fitted to each other, is inserted into an elastic-lance escaping space to form a predetermined gap with respect to the elastic lance that is on an inner side is formed in the male housing, the elastic-lance escaping space being formed outside the elastic lance and in the female housing in order to allow the elastic lance to be displaced to a position that is deviated from the elastic wall portion, the elastic lance is outwardly pressed by the displaced elastic wall portion to be displaced in the gap, and then butted against the elastic-lance pressing portion.

* * * * *